US005559490A

United States Patent [19]

McDonald et al.

[11] Patent Number: 5,559,490

[45] Date of Patent: Sep. 24, 1996

[54] ELECTRONIC SCORING APPARATUS FOR DART GAMES

[75] Inventors: Joseph A. McDonald, Quincy; Algis E. Karosas, Hingham, both of Mass.

[73] Assignee: Majek, Inc., Braintree, Mass.

[21] Appl. No.: 275,126

[22] Filed: Jul. 14, 1994

[51] Int. Cl.[6] ..... G08B 23/00

[52] U.S. Cl. ..... 340/323 R; 364/411; 273/317; 273/DIG. 26

[58] Field of Search ..... 340/323 R; 364/410, 364/411; 273/317, DIG. 26

[56] References Cited

U.S. PATENT DOCUMENTS

| | | | |
|---|---|---|---|
| 4,266,214 | 5/1981 | Peters, Jr. | 340/323 R |
| 4,567,461 | 1/1986 | Honekman et al. | 340/323 R |
| 4,793,618 | 12/1988 | Tillery et al. | 273/DIG. 26 |
| 4,824,121 | 4/1989 | Beall et al. | 273/376 |
| 5,318,319 | 6/1994 | Jones et al. | 273/371 |
| 5,384,561 | 1/1995 | Smith | 340/323 R |

FOREIGN PATENT DOCUMENTS

| | | |
|---|---|---|
| 1563601 | 3/1980 | United Kingdom . |
| 2087734 | 6/1982 | United Kingdom . |

OTHER PUBLICATIONS

"Computer Chalkboard" Horizon Dart Supply.

"Cricket Master" Arachnid Inc.

"Pro Challanger With Cricket" Custom Mfg. Inc.

*Primary Examiner*—Jeffery Hofsass
*Assistant Examiner*—Daniel J. Wu

[57] ABSTRACT

An electronic scoring apparatus for use in a plurality of dart games, which apparatus minimizes a user's mathematical calculations, thus keeping scoring errors to a minimum and avoiding tedious mental calculations. The apparatus includes input switches to input data, lighted displays which inform the user, and selection input switches by which the user selects and customizes a plurality of games and enters scoring information. The apparatus is provided with displays which inform users and spectators of game circumstances. The apparatus suggests targets at which to throw, in response to game situations. Games can be played versus the apparatus at various selected skill levels. A plurality of games can be played with more than two teams. Lighted displays portray characters historically used in the dart game of Cricket.

5 Claims, 5 Drawing Sheets

ELECTRONIC SCORING APPARATUS FOR DART GAMES

BACKGROUND OF THE INVENTION (1) Field of the Invention

This invention relates to an electronic scoring device for games of darts, and more specifically to a scoring device including a display for scores, means interfacing with a user, means suggesting targets at which to throw, and means for scoring games versus the device.

(2) Description of the Prior Art

Most dart games are presently scored using markers of sorts and writing surfaces. Most common of scoring implements are chalk and a chalkboard. Such scoring implements are basically used to tally, in one manner or another, dart hits on target areas required for a game being played. Some problems encountered with such scoring means are scoring legibility, presence of chalk dust, the locating of misplaced writing and erasing instruments, light reflections off of chalk boards obscuring scoring information, and scorekeeping mistakes.

A standard dart board in use today is circular, with a surface for receiving a pointed projectile which hits a target area thereon. Projectiles are usually thrown from a distance of about eight feet from the dart board. Twenty equally sized wedge shaped target areas typically are designated on the board, giving the dart board an appearance of a cut-up pie. Number values of one through twenty are associated with the twenty target areas. Each wedge has within its confines distinct target areas. One such target area which takes up about seven percent of the wedge's area is a triple, or treble, target. A single dart impacting in the triple area counts as three hits on a given number for many games. Another area, similar to the triple, and taking up about eleven percent of a wedge is a double target. A dart impacting in the double target area normally counts as two hits on the given number for many games. A dart impacting in a wedge that is neither a double nor a triple is considered a single hit on the given number. In addition to the wedges, there are two concentric rings in the center of the dart board. The area of the smaller circle is a double bull's eye, and the rest of the area within the larger circle is a single bull's eye. Thus, in all, there are sixty-two different scoring areas, or beds, on a standard dart board.

Countless dart games have been invented throughout the history of the sport. Four very popular games today are "01", Cricket, Burma Road, and Count, each with its own variations.

In a game generally referred to as "01" participants agree on a starting score which ends with digits "01". Examples of typical starting scores are 301, 501 and 601. The object of an "01" game is to achieve the starting score exactly, with the final dart scoring on a double. Printed lists are available and often posted in darting establishments which offer suggestions to a thrower as to preferred target areas to hit in order to win with two or three darts. A problem with such lists is that to use them after having thrown one or two darts, a player sometimes must first perform mental multiplication, addition and subtraction in order to arrive at an intermediate score. Also, such lists do not normally suggest target areas when more than three darts are required to finish a game. Variations of "01" have different requirements regarding the start of the scoring. Basically, each side subtracts an amount of points hit on a three dart throw from that side's previous total. Thus, for example, if in the game of 301 one side started with a double twenty, triple nineteen, and a single seven, the scorekeeper would be required to perform the corresponding multiplications and additions to arrive at a three dart total of 104, and then subtract that total from 301, giving a remaining score of 197. Clearly, scorekeeping in darts can be a difficult task for those not well versed in mathematics, or in fast-paced games.

In a game referred to as "Cricket" sometimes called "American Cricket" relevant target areas are the 15 through 20, plus the bull's eye. A point value of 25 is associated with a single bull's eye. The object of the game is to get three hits on each target area and to have a point total greater than or equal to an opponent. The first three hits on a given number do not score points. Hits in excess of three (for an entire game) score points corresponding to the target area hit, provided the opponent has not yet effected three hits in that target area. When both sides have three hits in a given target area, that area is no longer used for further scoring. Scores are tallied at the end of a three dart throw. If a player initially makes a single hit on a target area with three darts, the most common technique for tallying this event is to mark a slash (/) next to the corresponding number or bull's eye for that player's or team's side. If, on the second round of darts, the same player hits the same target area once, it is normally tallied as a backslash (\) through the original slash, forming an "X". The order of the slashes is not critical, but an "X" remains after two hits. If, on the third round the same player hits the same target area once, it is normally tallied as a circle going approximately around the previously scored "X". The circle, in fact, means that the given player has three hits on the given target whether or not previous slashes have been recorded. So, if a player gets more than one hit including a third hit on a given target for a round, the scorekeeper normally only records a circle and skips filling in any intermediate slashes. An interesting result of such scorekeeping is that one can often deduce the general ability of participants by noting the lack of slashes in a game well progressed. Better players, in general, will have less slashes since they often have three or more hits for a given round.

In a game referred to as "Burma Road", also known as "Halve-It" "Double Down" and "Murder" a specific target area is required for each round of three darts. Nine rounds are usually played by each player. Each player starts with an initial score, perhaps 100 or 40, or whatever is agreed to by the participants. A player hitting the required target adds the corresponding point total to his/her score. A player missing the required target with all three darts is penalized by the integer part of half of his/her points. Burma Road is a game that can be played by any number of people, and is often played by seven or more. Each individual's score is tracked. If a tie for first place exists at the end of nine rounds, tied players can play extra rounds until a winner is determined. As can be deduced by the rules of this game, setting up and maintaining a scoreboard for a large group of people can be a tedious task, and difficult on a small scoreboard. Electronic scoreboards for Burma Road are not commonly available.

In a game referred to as "Count" also known as "Count up" a point total for each round is added to a participant's score. There are several variations of this game. When a predetermined point total is reached, or a predetermined number of rounds are thrown, a winner is determined. As in Burma Road, several players can play this game at once. A variation of this game is called "Baseball". In Baseball, each player throws a first round of three darts at the wedge numbered 1. A second round is thrown at the 2, third at the 3 and so on through the ninth round, or inning. One point is scored per hit regardless of the number of the target area.

Ties are resolved with extra innings. "Shanghai" is a game like Baseball, except that the hits on valid numbers are multiplied by that number before being added to the score. Also, the number of rounds can be different than nine, as pre-decided by the participants. Shanghai can end abruptly if a player gets a single, double and a triple of a required number, whereupon that player wins. Other rules in variations of Shanghai call for penalties for missing numbers. As in Burma Road, setting up and maintaining a scoreboard for a large group of people can be a tedious task, and difficult on a small scoreboard.

Electronic dart scoreboards have been proposed and manufactured in the past to help alleviate scoring problems. U.S. Pat. No. 4,567,461, issued Jan. 28, 1986 to Honekman, et al., shows an electronic dart game scoreboard which has an array of switches dedicated to game selection, requires auxiliary input and display means, and has input switches which are dedicated solely to the first three hits on Cricket numbers. The scoreboard of Honekman provides for point totals of only up to 99 points for a three dart round where 180 points are possible. Another problem associated with that scoreboard is that if the player gets, for instance, five twenties on the first round, the scorekeeper is laboriously required to activate the twenty switch three times on the dedicated Cricket keys, and then calculate in his/her head that there are two excess twenties, multiply two by twenty, and enter forty on the keypad. Another problem is that there is no recourse from an accidental closure of its reset input switch. The dart scoreboard of the aforementioned patent, plus other units available on the marketplace today, only show LED (Light Emitting Diode) dots to indicate the first three hits on a given number in Cricket. Thus, those scoreboards cannot practically show an indication of a player's ability in Cricket. Those scoreboards do not skip over LEDs for multiple hits in a round on a given number, probably because it would be difficult to discern from a distance the number of hits that had been made on a given number. For instance, if the first player got three twenties and an opponent did not witness such event but relied on the scoreboard, he/she would see just one lit LED. That would not be an obvious indication from eight feet away that his/her opponent had three twenties. Also, the aforementioned U.S. patent, and units available on the marketplace, do not provide for combining a three dart total, thus often requiring the scorekeeper to perform mental multiplication and addition and to enter the result on the given unit. There has been a long standing need to eliminate mathematical calculations on the part of the score keeper in the game of darts. Present electronic scoreboards for darts do not show which target areas have been hit, but merely a summation of points for three dart rounds. There is a need, especially in league play, to verify that the score keeper's entry corresponds with the target areas hit.

United Kingdom Patent Application No. 2,087,734, published Jun. 3, 1982, in the name of William G. Rutter, describes an electronic apparatus which performs a function similar to the printed lists which suggest ways of winning "01" games. A problem with that apparatus is that it requires a thrower to perform division in order to arrive at target areas at which to throw. Further, that apparatus does not provide suggestions for throws when more than three darts are required to finish a game.

SUMMARY OF THE INVENTION

An object of the invention is to provide a scoring device operative to eliminate the need for addition, subtraction, and multiplication on the part of the scorekeeper; to provide a lighted graphical representation of Cricket symbols which have been used for many years; to activate Cricket symbols in a manner providing a general indication of a player's ability; to provide scoring for a plurality of games which can be selected by a single key; to show the quantity of hits and the corresponding target area number which was hit for any three dart throw; to provide twenty three input switches which, with a maximum of two keystrokes can define any of the sixty two different scoring areas on a standard dart board; to provide suggestions as to beds at which to throw, that is, to coach the thrower, at any point in the games of Cricket and "01"; to allow a user to select an ability at which to play versus the device; in games versus the device, to increment or decrement the level of difficulty of the device versus the user by an amount pre-selected by the user if the user wins or loses, respectively; and in Cricket games versus the device, to score points to the extent possible if the device has less points than the user, or otherwise score three of each of the Cricket numbers and bull's eye.

With the above and other objects in view, as will hereinafter appear, a feature of the present invention is the provision of an electronic scoring apparatus for dart games comprising a housing, a control and display panel on the housing, means on the panel for selection of one of a plurality of dart games, a game selection light array on the panel, and scoring entering means for the plurality of games on the panel. The apparatus further includes two lighted numerical displays, each of the numerical displays comprising a plurality of digits for indicating individual scores, a lighted entry display field indicating quantities of hits, and targets hit, for any three dart throw, input switches adapted to define any of sixty-two scoring areas on a dart board with no more than two keystrokes, and a plurality of displays on the panel for a dart game of Cricket, in which the first three hits for targets are lighted and display symbols historically used in the game of Cricket.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF THE PREFERRED EMBODIMENT

Figure 1:
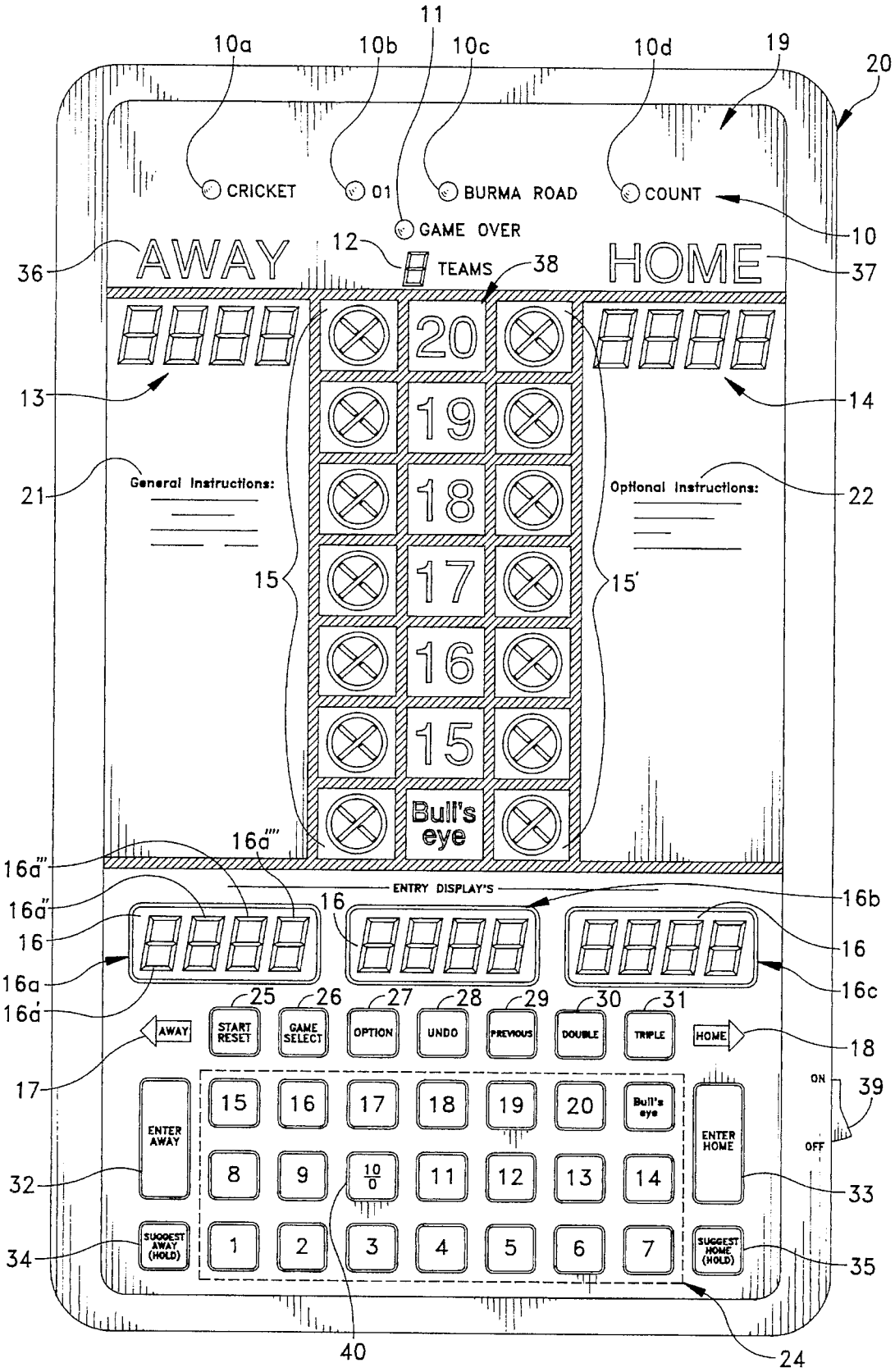
FIG. 1 is a front elevational view of one form of a scoring device illustrative of an embodiment of the invention.

Referring to the drawings, there is shown in FIG. 1 an external front view of a preferred embodiment of the present invention. A housing 20 holds the main body of the present invention, and is adapted for connection to an external direct current power supply (not shown) which is common to the art of electronics. A panel 19 is fixed to housing 20 and is provided with lighted displays, input switches, and information for a user. A word "AWAY" 36 indicates one side for a given game, and a word "HOME" 37 indicates the other side. These designations can be considered arbitrary and are representative of any names of sides in a two-sided game. A game selection light array 10 comprises a plurality of light sources 10*a*, 10*b*, 10*c*, and 10*d* which indicate a game selected. A light source 11 is used to indicate a game over condition. A lighted number 12 indicates how many teams are involved in the current game. A "1" signified by light 12 indicates that a game is being played against the apparatus. A numerical display 13 and a numerical display 14 each contain a plurality of digits, preferably at least four. Displays 13 and 14 show point totals for participants in a game up to a given point in the game. An area 21 has instructions for the user regarding general operation of the unit. An area 22 has instructions for the user regarding options which may be selected relevant to different games. Such instructions inform a user how to customize a game to his/her liking.

A plurality of displays 16*a*, 16*b*, and 16*c* show quantities and numbers hit for any possible three dart throw, which were input by a score keeper. A display digit 16*a*' indicates a quantity; display digit 16*a*" shows a dash or other delimiter which separates the quantity from a target area number; and 16*a*'" and/or 16*a*"" show a target area number. Displays 16*b* and 16*c* are used in a like fashion. In the game of Burma Road, a score keeper's input is only shown briefly upon completion. Then display 16*a* is used to show which round is under way, display 16*b* is used to indicate the target at which to throw. In games of more than two players, numbers are assigned to individuals. Display 16*c* is used to indicate which player's turn is next. In the game of Count, the round number and player number are displayed in the same way as Burma Road. Additionally, displays 16 are used, upon user demand, to show suggestions of targets at which to throw in the course of a plurality of games. A light source 17 and a light source 18 are used to indicate to which side displays 16 pertain, for two player games and for games versus the apparatus. An input switch 32 entitled "enter away" and an input switch 33 entitled "enter home" are used to terminate user input for a given player's round of three darts. An input switch 34 entitled "suggest away (hold)" and an input switch 35 entitled "suggest home (hold)" are used to show targets in displays 16 so as to advise the shooter of preferred targets at which to throw in a plurality of games.

An input switch 25 entitled "start/reset" is used to abort a game in progress. Input switch 25 is also used to initialize displays after a game is completed. An input switch 26 entitled "game select" is a single key which can be used to select a plurality of games. An input switch 29 entitled "previous" is used to display previous scores for the purpose of verifying past entries, canceling past entries, or satisfying curiosity as to the content of past entries. An array of twenty-one input switches 24 represents every number on a standard dart board, plus the bull's eye. This input switch array 24 is used for score keeper input to indicate that a given number or bull's eye had been hit. Multiple presses on the same numbered switch can indicate multiple hits by the thrower on the same target. In addition to inputting information regarding dart hits, these keys may be used for selecting options and entering other data. An input switch 40, which is entitled "10/0" is a context sensitive switch which represents target area numbered ten when dart hit entries are being made and zero when option information is being entered. An input switch 30 entitled "double" is used as a prefix switch to any of the switches in input switch array 24 to indicate that two hits had been made in the target area represented by a given number. An input switch 31 entitled "triple" is used in a like fashion. Additionally, double switch 30 and triple switch 31 can be activated singly, or in various combinations, before pressing a target area switch in input switch array 24 to indicate that the target area had been hit from two to nine times. The combination of input switch array 24, double switch 30, and triple switch 31 allows a user to select any of the sixty-two different target areas on a standard dart board with the press of no more than two keys. An input switch 27 entitled "option" is used in conjunction with input switch array 24 to customize games to a user's liking. An input switch 2e entitled "undo" is used to restore an aborted game, erase an entry which is uncommitted to home or away, or to cancel a previous entry. An on/off switch 39 is used to apply or terminate electrical power to the apparatus.

For the game of Cricket, display areas 15 and 15' are used to show graphical images which represent up to three hits on a given target. The target numbers and bull's eye designations 38 are adjacent to the display areas 15, 15'. An array of lighted graphical characters 15 pertain to the away side, and an array of lighted graphical characters 15' pertain to the home side. A more detailed description of the graphical images follows.

Figure 2A:
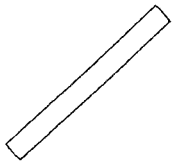
FIGS. 2*a*, 2*b*, 2*c*, 2*d*, and 2*e* are illustrations of characters which have been historically used in the dart game of "Cricket" to represent the first three hits on valid scoring areas, and which are displayed by the illustrative device.
Figure 2B:
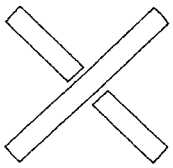
Figure 2C:
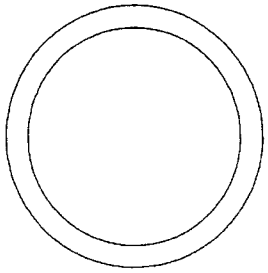
Figure 2D:
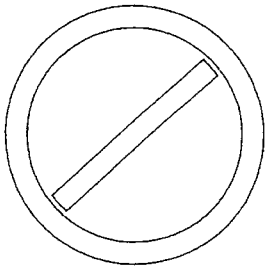
Figure 2E:
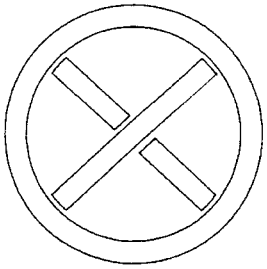

FIGS. 2*a* through 2*e* show graphical representations historically used in the game of Cricket to represent the first three hits on each target area. Any one of these representations, or a blank (not shown), can appear in the lighted array 15 or lighted array 15' in FIG. 1. A "number" in this paragraph refers to any number associated with a valid target area for the game of Cricket, including a bull's eye. FIG. 2*a* is used to show that one hit has been made on a given number. FIG. 2*b* manifests that two hits have been made on a given number. FIG. 2*c* manifests that three hits have been made on a given number, and that the player has gone from no hits on that number to three hits on that number in a single three dart throw. FIG. 2*d* manifests that three hits have been made on a given number, and that the player has gone from one hit on that number to three hits on that number in a single three dart throw. FIG. 2*e* manifests that three hits have been made on a given number, and that the player has gone from two hits on that number to three hits on that number in a single three dart throw.

Figure 3:
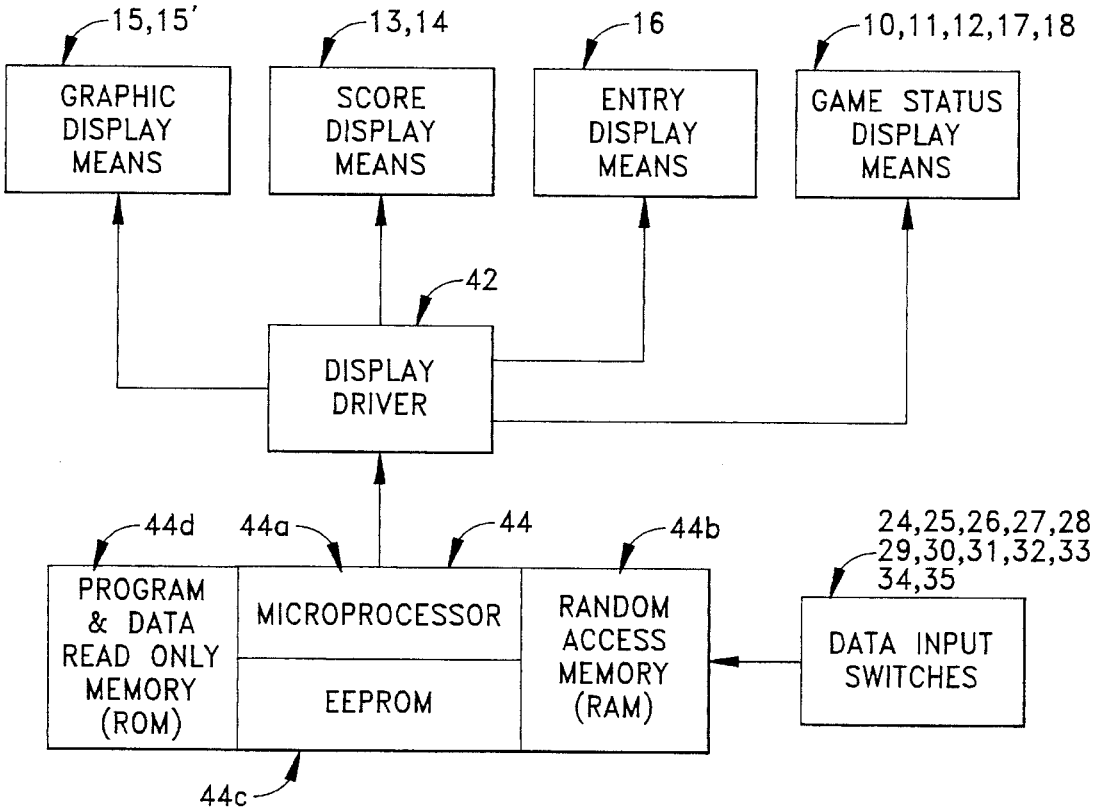
FIG. 3 is a block diagram illustrating electronic sequences for the device of FIG. 1.

FIG. 3 is a block diagram of major electrical components in a preferred embodiment of the present invention. An integrated circuit 44 with on-chip microprocessor 44*a*, Random Access Memory (RAM) 44*b*, Electrically Erasable Programmable Read Only Memory (EEPROM) 44*c* and Program and Data Read Only Memory (ROM) 44*d* is the center of the invention's electronics. Microprocessor 44*a* fetches an instruction from a ROM 44*d*. Such instructions, as a whole, make up a computer program which controls the present invention. Microprocessor 44*a* then interprets and executes the instruction. Microprocessor 44*a* repeats the preceding sequence as long as the unit remains powered up. Direct current is supplied to all electrical components by a power supply (not shown). A plurality of data input switches 24, 25, 29, 30, 31, 32, 33, 34, 35, when activated, transmit electrical signals which interrupt microprocessor 44*a* from what it is doing at the time. Then, a code representing a particular input switch which was activated is stored by way of computer program control. Such a code is later interpreted and processed in accordance with the computer program stored in ROM 44*d*. Once an input switch signal is processed, it is thereafter ignored. Some instructions trigger the reading of data from ROM 44*d*. Other instructions stored in ROM 44*d* cause codes to be sent to a display driver 42. Those codes are interpreted by display driver 42 which, in turn, activates or extinguishes the graphic display means 15, 15', score display means 13, 14, entry display means 16, or game status display means 10, 11, 12, 17, 18. Other computer instructions from ROM 44*d* cause microprocessor 44*a* to store and retrieve data on the integrated circuit 44 of which it is a part. Such data is stored in RAM 44*b*, which is volatile memory, and EEPROM 44*c*, which is non-volatile memory. Non-volatile memory is preserved when the apparatus is turned off, whereas volatile memory is lost.

Figure 4:
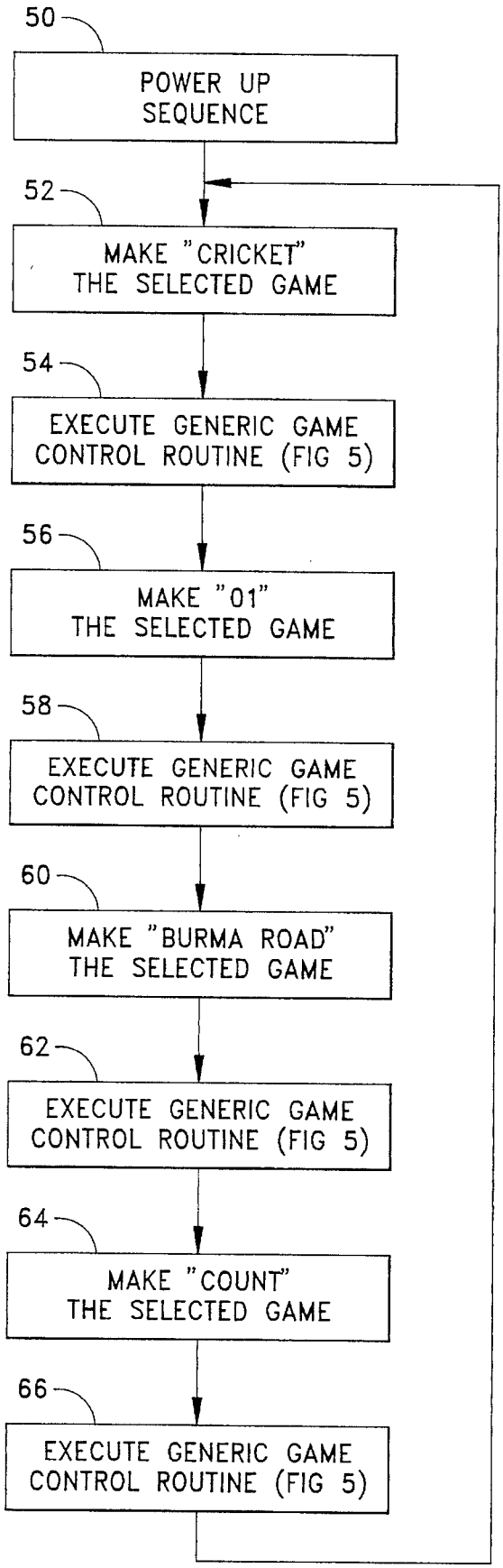
FIG. 4 is a data flow diagram illustrative of a game selection process in accordance with the invention.

FIG. 4 shows a flow chart for game selection. Switches in the following discussion refer to FIG. 1. When on/off switch 39 is activated, the apparatus performs a power up sequence 50. Such sequence performs all required initialization of electrical components. The apparatus then makes Cricket the selected game in step 52 and proceeds to execute a generic game control routine in step 54. Generic game control routine 54 is shown in detail in FIG. 5 and will be discussed later. To proceed along the flow chart of FIG. 4, input switch entitled "game select" 26 must be pressed. The selected game then becomes "01" in step 56. As before, the generic game control routine is executed in step 58. When input switch 26 is next activated, it causes the game selection to advance; Burma Road is selected in step 60 and generic game control routine is executed in step 62. When input switch 26 is next activated, it causes the game selection to advance; Count is selected in step 64 and generic game control routine is executed in step 66. When input switch 26 is next activated, it causes the game selection to advance; Cricket is selected in step 52 and the process repeats as long as on/off switch 39 remains closed.

Figure 5:
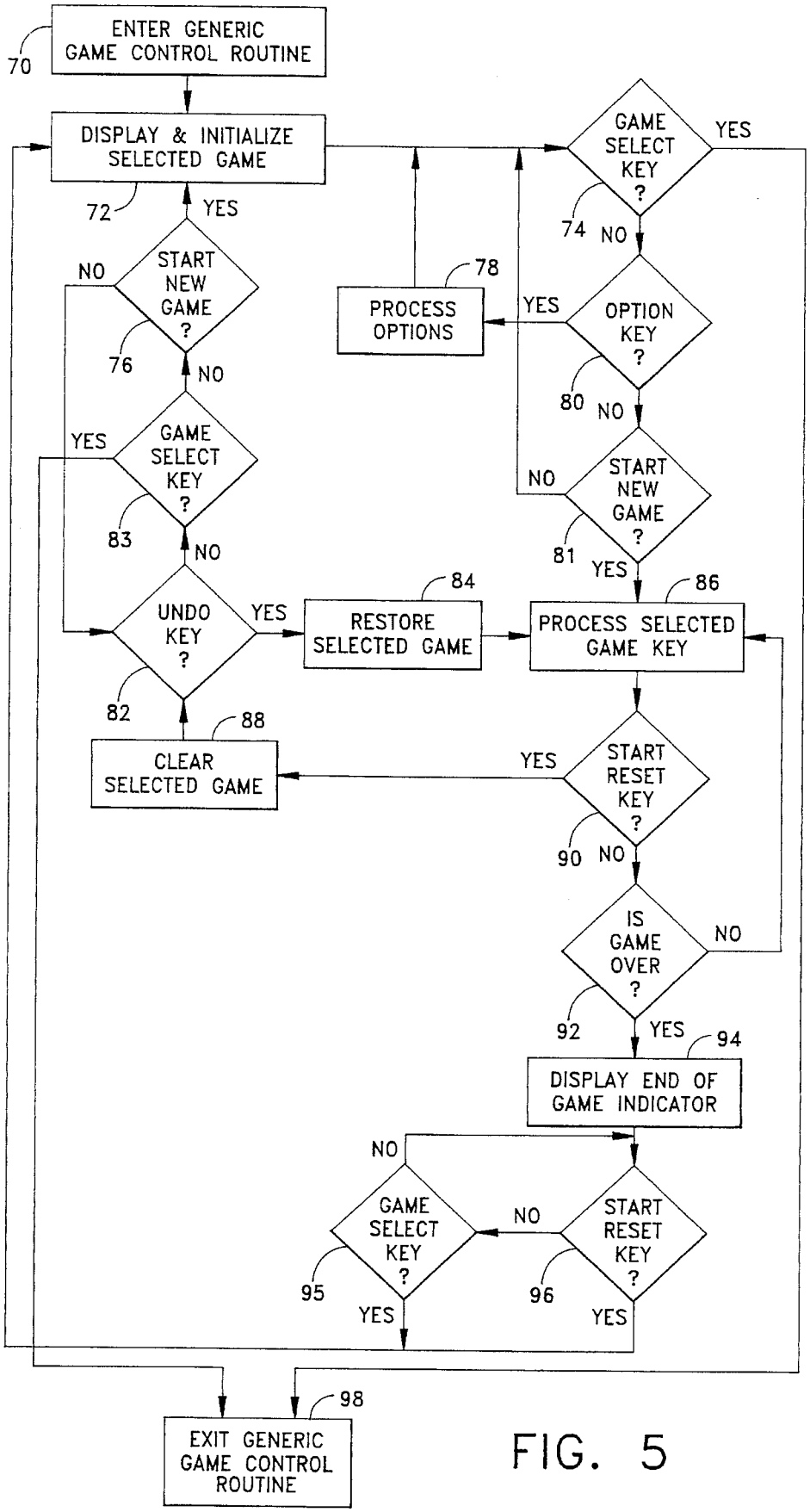
FIG. 5 is a flow chart illustrative of a generic game control computer routine.

FIG. 5 shows a generic game control routine flow chart. Switches and lighted displays referenced in this discussion refer to FIG. 1, and other references refer to FIG. 5, except where otherwise noted. The word "key" in FIG. 5 means input switch. Program flow enters this routine in step 70. In step 72 lighted displays 10, 11, 12, 13, 14, 15, 15', 16, 17 and 18 are initially extinguished. Also, all internal memory associated with the selected game is initialized. A light within light array 10 appropriate for the game selected is illuminated. The number of teams last selected for the current game is illuminated by display 12.

For the special case of Burma Road, a target required for scoring is shown in display 16*b* (FIG. 1) and the round number is shown in display 16*a*. In Burma Road games with more than two players, the player number is shown in display 16*c*. The apparatus then proceeds to step 74 (FIG. 5) where it determines whether or not the input switch entitled "game select" 26 has been pressed. If it has been pressed, the routine is exited in step 98. If it has not been pressed, the apparatus proceeds to step 80 where it determines whether or not input switch entitled "option" 27 has been pressed. If so, step 78 is executed, where a user can, via input switches 24, enter a code as described in option instructions 22 of FIG. 1. Option number is shown in display 16*b*, and if additional information is required, such selections are input via input switches 24 and shown in display 13.

An example of an option entry is, for a game of "01", wherein the user presses "option" input switch 27. A cursor common to computer technology blinks in display 16*b*, prompting the user for a code. The user selects option two by pressing input switch labelled "2" within input switch array 24. The blinking cursor is extinguished and a "2" appears in display 16*b* which indicates that the user is about to enter a level of difficulty for the apparatus for use in a game versus the apparatus. A blinking cursor appears in display 13, prompting the user to enter a level of difficulty. He/she enters, for example, "21" which represents a level of difficulty for the apparatus where the apparatus will complete a game of "01" in twenty-one darts. The user can then select option "3" if desired, and input an automatic change in the level of difficulty of the apparatus upon completion of a game. For instance, if he/she selects "2" for option three, the level of difficulty of the apparatus, in the example given, will change by two darts to twenty-three (a decrease in difficulty) if the user loses the game, and will change to nineteen (an increase in difficulty) if the user wins the game.

Option switch 27 can also be used to select a quantity of teams which is shown in display 12, and for entering targets for the game of Burma Road. Step 74 is then re-executed. If option switch 27 has not been pressed in step 80, the program, in step 81, determines whether any of input switches 24, 30, 31, 32, or 33 has been activated which starts scoring for a new game. If no new game has been started, the program flow goes back to step 74. Otherwise, the key detected in step 81 is processed in step 86 according to the rules of the selected game. Such rules include the displaying of dart hits in display 16 in the form of a multiplier from one to nine and the number of the target area on which the dart scored. A dash or other delimiter is illuminated to separate a multiplier from a number. Input switch entitled "previous" 29 displays previous entries in display 16 and indicates which side received that score with a light labelled "away" 17 or "home" 18. Input switch entitled "undo" 28 erases an entry shown in display 16 if the entry has not yet been entered with input switches 32, 33 entitled "enter away" or "enter home". If such an entry has been entered, not only is display 16 cleared, but scoring for the appropriate side is adjusted. If input switch 32 entitled "enter away" or 33 "enter home" has been pressed, the apparatus applies scoring information shown in display 16, if any, to the appropriate side and also lights an appropriate light labelled "away" 17 or "home" 18 indicating which side received the last score.

Total points for a game are shown in display 13 for the side designated as "away" and in display 14 for the side designated as "home". Also, for the game of Cricket, graphical images representing the first three hits for the numbers pertinent to the game are shown in display 15 and display 15'. In the case of either "enter away" 32 or "enter home" 33 being activated, the program stores that information so that when the next input switch of 24, 30, 31, 32, or 33 is received, display 16 is erased before further processing of that next input switch.

For the games of Burma Road and Count, when more than two opponents are involved, the side designated "HOME" 37 in FIG. 1 is used to show scoring information for the latest player. The side designated "AWAY" 36 in FIG. 1 is used to show scoring information for the player preceding the latest player. Scores scroll from right to left as the game progresses. If input switch 34 entitled "suggest away (hold)" or 35 "suggest home (hold)" has been pressed, the apparatus displays a suggestion in display 16 regarding preferred targets at which to throw darts for the respective side for as long as a user maintains activation of such input switch.

For a game of "01" the apparatus suggests a way to win the game if possible. If not possible, the apparatus suggests throws which would leave a preferred score for the next three dart throw. If hits of less than three darts are shown in displays 16, but not yet entered with input switch 32 or 33, the apparatus suggests preferred targets for the remaining darts. Upon release of input switch 34 or 35, display 1 returns to its state before such switch was activated. The program then flows to step 90 where activation of "start/reset" input switch 25 is checked. If that switch has not been activated, the apparatus checks the game situation to determine whether or not the game has been won in step 92. If so, "game over" light 1 is illuminated in step 94 . The apparatus then proceeds to step 96 where it determines whether or not the input switch entitled "start/reset" 25 has been pressed. If it has been pressed, step 72 is then re-executed. If it has not been pressed, step 95 is executed, where the program determines whether or not the input switch entitled "game select" 26 has been pressed. If it has been pressed, step 72 is re-executed, and if not, step 96 is re-executed.

Turning back to step 90, if "start/reset" input switch has been activated at that point, the program clears the selected game in step 88. Such clearing involves displays 15', 16, 17, 18, but not internal memory containing heretofore registered scoring information associated with the selected game. The program proceeds to step 82 where prior activation of "undo" switch 28 is checked. The purpose of this step is to give the user a chance to correct an inadvertent closure of "start/reset" switch 25. If "undo" switch 28 has been activated, the program, in step 84, reads RAM **44*b* (FIG. 3) and restores all displays to the state in which they were at step 90. The program then executes step 86 again. If, in step 82, it was determined that "undo" switch 28 has not been pressed, the program proceeds to step 83 where it is determined whether or not "game select" switch 26 has been pressed. If so, the program exits the generic game control routine via step 98; otherwise, a check is made in step 76 to determine whether or not a new game has been started, in the same manner as step 81. If a new game has started, the program proceeds back to step 72; otherwise, the program re-executes step 82**.

Figure 6:
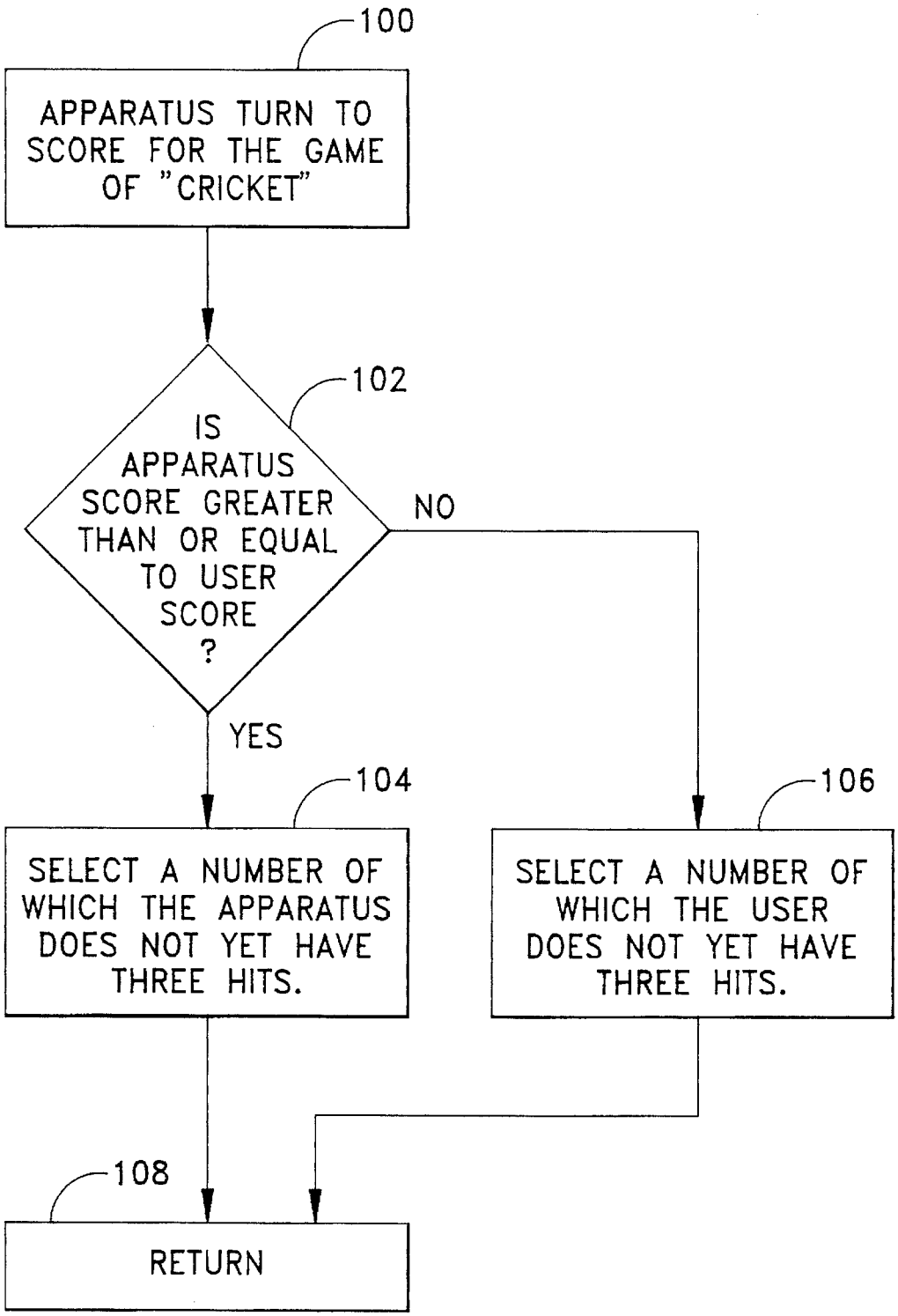
FIG. 6 is a flow chart which illustrates the strategy of the device in Cricket games versus the device.

FIG. 6 is a flow chart illustrative of a computer program segment which provides a strategy for the game of Cricket. It is executed during games versus the apparatus when it is the apparatus's turn to score as in step 100. Then, in step 102 it is determined if the apparatus's score is greater than, or equal to, the user's score. If so, the apparatus selects a number of which it does not yet have three hits in step 104. This is considered defensive play. The routine of FIG. 6 then returns back to the main program flow in step 108. If the answer to the question of step 102 is no, then the apparatus plays in an offensive manner, attempting to at least achieve a tie in points with the user. This is done in step 106 where the apparatus selects a number of which the user does not yet have three hits. The routine then returns back to the main program flow. Within the framework of number selection outlined above, the order of preference for numbers for the apparatus is 20, 19, 18, 17, 16, 15, and then bull's eye, although other orders are possible.

Although the illustrated embodiment of the present invention has been described in detail, it should not be construed as the sole embodiment. Changes and modifications to the present invention will be obvious to those skilled in the art without departing from the invention in its broader aspects. Such alterations are matters of routine engineering or will be apparent after study. Therefore, the scope of the invention should not be limited to the herein described embodiment, but should be defined by the claims that follow. The claims are intended to cover the aforementioned changes and modifications that fall within the true spirit and scope of the invention.

The invention is claimed as follows:

1. An electronic scoring apparatus for dart games comprising:

a housing, a control and display panel on said housing, means on said panel for selection of one of a plurality of dart games, a game selection light array on said panel, scoring entering means for said plurality of games on said panel, two lighted numerical displays, each of said numerical displays comprising a plurality of digits for indicating scores, a lighted entry display field indicating quantities of hits, and targets hit, for any three dart throw;

input switches adapted to define any of sixty-two scoring areas of different numerical values on a dart board with no more than two keystrokes, and a plurality of displays on said panel for a dart game of Cricket, said displays being operable to indicate the first three hits for each of said targets by at least five display symbols historically used in said game of Cricket; wherein said lighted displays for said first three hits on each of said targets in said game of Cricket are illuminated in such a fashion as to provide an indication of the score for said first three hits and the manner in which said score was compiled, whereby to provide an observer of said apparatus with an indication as to the ease with which a player compiled said score.

2. An electronic scoring apparatus for dart games comprising:

a housing, a control and display panel on said housing, means on said panel for selection of one of a plurality of dart games, a game selection light array on said panel, scoring entering means for said plurality of games on said panel, two lighted numerical displays, each of said numerical displays comprising a plurality of digits for indicating scores, a lighted entry display field indicating quantities of hits, hit, for any three dart throw, input switches adapted to define any of sixty-two scoring areas of different numerical values on a dart board with no more than two keystrokes, wherein said entry display field is adapted to indicate suggestions of target areas at which to throw.

3. An electronic scoring apparatus for dart games comprising:

a housing, a control and display panel on said housing, means on said panel for selection of one of a plurality of dart games, a game selection light array on said panel, scoring entering means for said plurality of games on said panel, two lighted numerical displays, each of said numerical displays comprising a plurality of digits for indicating scores, a lighted entry display field indicating quantities of hits, and targets hit, for any three dart throw, input switches adapted to define any of sixty-two scoring areas of different numerical values on a dart board with no more than two keystrokes, wherein said apparatus includes means for entering a selected level of difficulty in said apparatus such that games played versus the apparatus automatically score at said selected level.

4. The electronic scoring apparatus for dart games in accordance with claim 3, wherein, for a game of Cricket versus said apparatus, said apparatus is adapted to score in an offensive manner if a user has a point score greater than said apparatus, and in a defensive manner if said user has a point score equal to or less than said apparatus.

5. The electronic scoring apparatus for dart games in accordance with claim 4, including means which, upon completion of said game versus said apparatus, increase said level of difficulty of said apparatus by an amount previously selected by a user if said user defeats said apparatus, or decrease said level of difficulty of said apparatus by an amount previously selected by said user if said apparatus defeats said user.

* * * * *